United States Patent [19]

Katsumoto et al.

[11] Patent Number: 4,798,517

[45] Date of Patent: Jan. 17, 1989

[54] PUMP

[75] Inventors: Takehiko Katsumoto, Kyoto; Kunio Kikuchi, Odawara, both of Japan

[73] Assignee: Mitsubishi Jidousha Kogyo Kabushiki Kaisha, Japan

[21] Appl. No.: 102,671

[22] Filed: Sep. 30, 1987

[30] Foreign Application Priority Data

Sep. 30, 1986 [JP] Japan ..... 61-148768[U]

[51] Int. Cl.[4] ..... F01D 7/00

[52] U.S. Cl. ..... 415/131; 415/140

[58] Field of Search ..... 415/34, 48, 129, 131, 415/140, 141; 416/186 A

[56] References Cited

U.S. PATENT DOCUMENTS

| | | | |
|---|---|---|---|
| 2,927,536 | 3/1960 | Rhoades | 416/186 A X |
| 2,957,424 | 10/1960 | Brundage et al. | 415/48 |
| 3,407,740 | 10/1968 | Samerdyke | 415/158 X |
| 3,482,523 | 12/1969 | Morando | 415/140 X |
| 4,070,132 | 1/1978 | Lynch | 415/131 X |

FOREIGN PATENT DOCUMENTS

| | | |
|---|---|---|
| 59-81734 | 6/1984 | Japan . |
| 59-116599 | 8/1984 | Japan . |
| 60-124597 | 8/1985 | Japan . |
| 61-59837 | 4/1986 | Japan . |
| 61-79817 | 4/1986 | Japan . |
| 61-142196 | 9/1986 | Japan . |
| 61-173723 | 10/1986 | Japan . |
| 62-24014 | 2/1987 | Japan . |

*Primary Examiner*—Robert E. Garrett
*Assistant Examiner*—Joseph M. Pitko
*Attorney, Agent, or Firm*—Lorusso & Loud

[57] ABSTRACT

The disclosed pump includes a casing housing a working chamber and an impeller. The impeller includes a blade wheel mounted on a rotational shaft, a plurality of pumping blades extending axially from the periphery of the blade wheel and a cover mounted within the casing and fitted over the blade wheel for rotation therewith. The cover includes an end face member defining one side of the working chamber and a cylindrical skirt portion depending from the periphery of the end face member and encircling the blade wheel and defining a hollow interior space within the impeller between the end face member and the blade wheel. The end face member has a plurality of slots through which the blades extend into the working chamber. The interior surface of the cover defines a plurality of pockets, each contoured to receive and mate with one of the blades so that in use each blade rests flush against one surface of the pocket with no space for fluid therebetween.

6 Claims, 3 Drawing Sheets

PUMP

BACKGROUND OF THE INVENTION

The present invention relates to a pump adapted to provide a variable volumetric delivery which can be freely adjusted and, more particularly, to such a pump having reduced fluid resistance to impeller rotation and having a cover for adjusting the effective length of the impeller blades.

A conventional pump for a water-cooled engine is so designed that the maximum volume to be delivered from the pump matches a full load operational range in which the maximum amount of heat is emitted from the engine. Since the volume of water delivered from the pump is in proportion to the number of revolutions of the pump, a volumetric excess of water recirculates, resulting in a waste of energy.

A number of proposals have been advanced for curbing such waste. One such approach uses a variable speed motor to drive the water pump, whereby the number of pump revolutions is varied in accordance with the existent operational state of the engine to adjust the volume of water delivered from the pump. This approach, however, has not been commercially utilized because of the expensive nature of the variable speed motor.

In another conventional variable delivery pump adjustment of the flow rate is achieved by providing movable members which may be moved to adjust the clearance between the movable members and the fore ends of the impeller blades, as disclosed, for instance, in Japanese Laid-Open Pat. No. 79817/1986. However, in this pump he movable members which move relative to the impeller blades are disposed on an extension of the rotational shaft on which the impeller is mounted.

SUMMARY OF THE INVENTION

The present invention has been made with the foregoing background in mind and its object is provision of a pump which is so constructed that resistance of the fluid within the impeller body to rotation of the impeller is minimized and, thereby, the rotational energy input to the impeller is not uselessly consumed.

To accomplish the above object there is provided according to the present invention a pump of the type including a casing in which a spiral chamber is formed and an impeller including a blade wheel fixedly mounted within the casing on a rotational shaft and having a plurality of blades attached thereto. The impeller further includes a cover having an end surface defining one side of the spiral chamber and having a plurality of slots formed in that end surface, through which the blades are inserted, and a cylindrical skirt portion fitted over the blade wheel. An actuator is incorporated in or on the casing for adjusting the axial displacement of the cover relative to the blade wheel. The cover and the blade wheel together define a hollow impeller interior. The inner cylindrical surface of the skirt portion of the cover defines a plurality of blade contact surfaces which mate with the working surfaces of the impeller blades to eliminate open space in front of (in the direction of rotation) the portions of the impeller blades extending into the hollow interior of the impeller (the blade portions to the right of the convex surface of the cover in FIG. 1).

Further, according to the present invention, each pocket formed in the skirt portion of the cover is further defined by a trailing surface, hereinafter "joint surface", which faces the blade contact surface with the blade interposed therebetween and which either lies in a radial plane extending from the center of rotation or is configured in such a manner that it increasingly slopes away from a radial plane, in the direction of rotation, as it approaches the outer cylindrical surface of the cover skirt Thus, the joint surfaces are configured to reduce resistance to rotation by water accumulated within the cover skirt pockets which receive the blades.

Other objects, features and advantages of the present invention will become readily apparent from a reading of the following description which has been made in conjunction with FIGS. 1 to 5.

DESCRIPTION OF THE PREFERRED EMBODIMENT

Now, the present invention will be described in more detail hereunder with reference in FIGS. 1 to 5.

Figure 1:
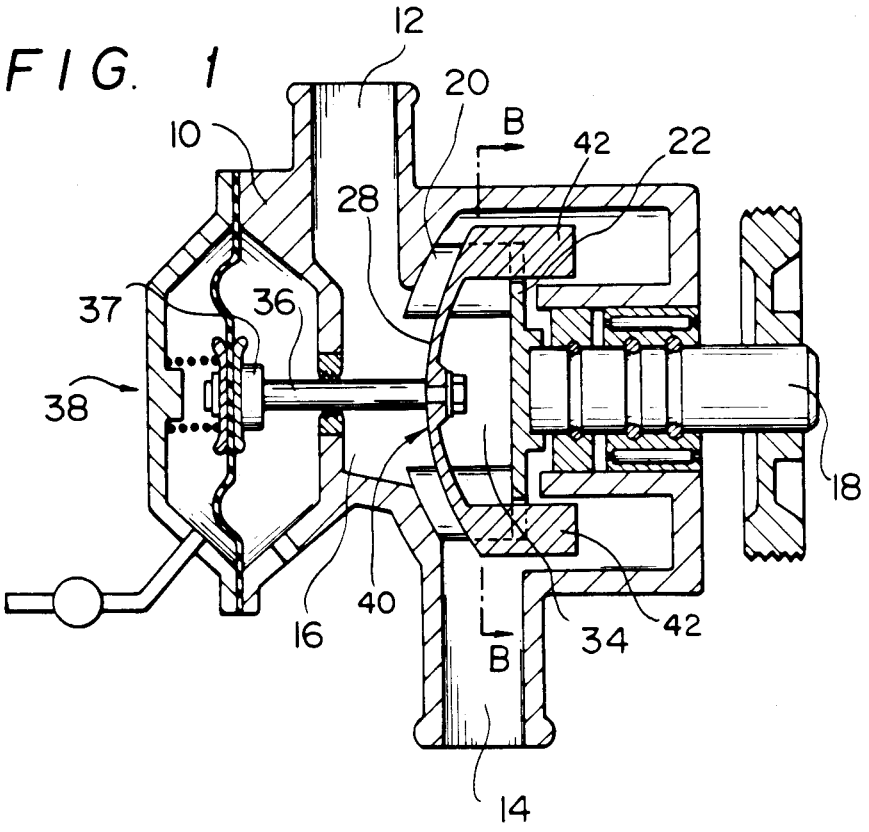
FIG. 1 is a sectional view of the impeller and working chamber of a pump in accordance with an embodiment of the invention.

FIG. 1 is a sectional view of the pump. The pump includes a casing 10 in which a spiral working chamber 16 is formed to define a path for liquid communication between a suction port 12 and an outlet port 14. Within the casing 10 is mounted a rotational shaft 18. The rotational shaft 18 is rotated by driving means which is not shown in the drawings. The impeller includes a blade wheel 22 having a plurality of blades 20 integrally formed therewith, as shown by the perspective view of FIG. 5, and fixed to the left end of the rotational shaft 18 as seen in FIG. 1. The blade wheel 22 has a plurality of radially extending projection arms 24, each of which carries at its terminal end, an integral, axially extending blade 20.

Figure 2:
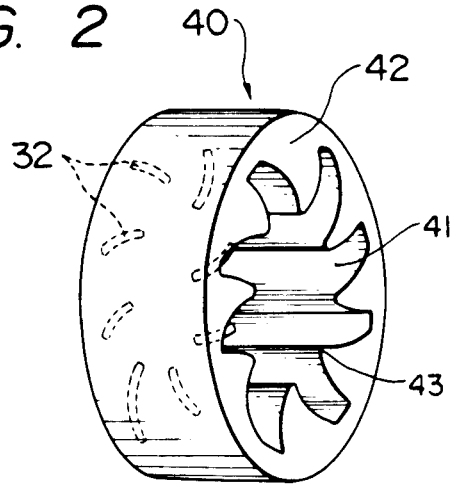
FIG. 2 is a perspective view of the impeller cover shown in FIG. 1.

A cover 40, shown in the perspective view of FIG. 2, is fitted over the blade wheel 22 for slidable movement in the axial direction relative to the blade wheel 22. The cover 40 has a slightly convex end surface 28 which defines one side surface of the spiral working chamber 16 and a cylindrical skirt portion 42. The cover 26 is formed with a plurality of slots 32 through which the blades 20 extend. Each of the blades 20 is so designed that it does not come out of its mating slot 32 over the range of sliding movement of the cover 40. A hollow space (hollow interior of the impeller) 34 is defined between the cover 40 and the blade wheel 22 and the volume of the hollow space 34 varies as the cover 40 slides relative to the blade wheel 22. Water enters and leaves the hollow space 34 through clearance between the slots 32 and the blades 20.

In the casing 10 is mounted a rod 36 fixedly secured to the central part of the cover 40 and an actuator 38 having a bearing 37 and adapted to slidably displace the rod 36 while the latter is rotating. The actuator 38 serves to slidably displace the cover 26 via the rod 36 under the effect of negative pressure or the like.

Figure 3:
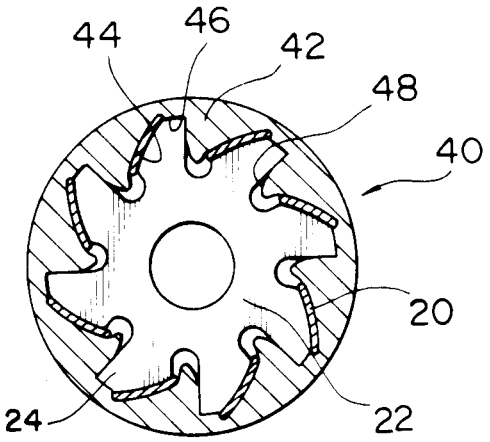
FIG. 3 is a sectional view of the pump taken on line B—B in FIG. 1.

The cylindrical skirt portion 42 of cover 40 is so configured that the blades 20 and radially extending arms 24 snugly fit within a plurality of pockets 41. Specifically, as shown in FIGS. 2 and 3, the cylindrical skirt portion 42 has a radial thickness at point 43 which is larger than the radial span of blades 20 and its inner cylindrical surface has a plurality of pockets, each pocket 41 receiving one blade 20 and providing a blade contact surface 44 adapted to mate with a working surface 39 of a blade 20. Each pocket 41 is further defined by a peripheral surface 46 in continuation with the blade contact surface 44 and by a joint surface 48 which is in continuation with both the peripheral surface 46 and with the blade contact surface 44. Each joint surface 48 lies in a radial plane extending from the center of rotation or is configured in such a manner that it increasingly inclines away from a radial plane, in the direction of rotation, as it approaches the outer cylindrical surface of skirt portion 42.

Since the cover 40 is constructed in the above-described manner, that portion of the working surface 39 of a blade 20 which extends into the cover 40 remains in contact with its mating blade contact surface 44. Thus, no open area exists in front of that portion of the working surface 39 of the blade 20 extending within the cover 40. As a result, there is no water within the impeller cover 40 and in front of a working surface 39 to resist rotation of blades 20 and the cover 40.

Figure 4:
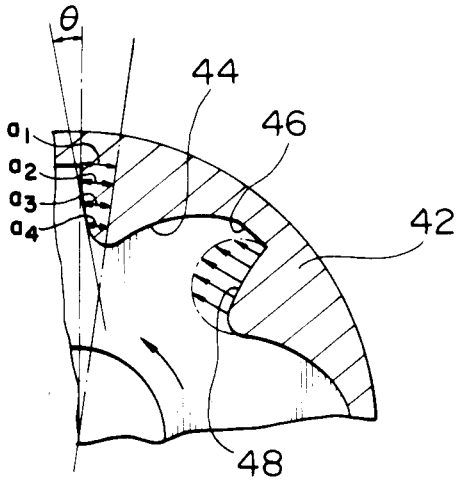
FIG. 4 is a fragmental enlarged sectional view of the cover.
Figure 5:
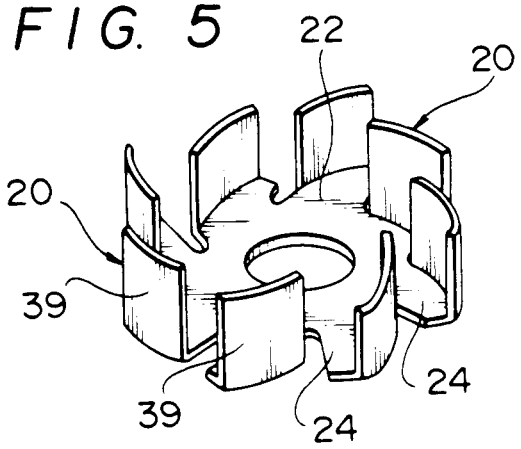
FIG. 5 is a perspective view of a blade wheel and blades, used in a preferred embodiment of the present invention.

However, the joint surfaces 48 must move against water as the impeller rotates. Accordingly, each joint surface 48 inclines away from a radial plane at an angle which increases as the surface 48 approaches the outer cylindrical surface of the cover 40 thereby minimizing the resistance to rotation by water in front of surface 48. This is illustrated in FIG. 4 wherein $a_1 > a_2 > a_3 > a_4$. Alternatively, but less desirably, joint surfaces 48 may be flat and lie in radial planes.

As is apparent from the above description, the pump of the invention uses a cover having pockets in its inner cylindrical surface, which pockets, in turn, provide surfaces which remain substantially in full contact with the portions of working surfaces of the blades extending through the cover into the impeller interior. Thus, resistance of water active on the blades in the hollow space within the cover can be eliminated during rotation. Consequently, the rotational energy of the blades can be utilized more efficiently than with a conventional pump.

Moreover, the configuration of the joint surfaces in the skirt portion of the cover further contribute to a reduction of the force of resistance to rotation by water within the hollow impeller interior, thus further increasing pump efficiency.

While the foregoing describes only a single preferred embodiment, it should of course be noted that various changes or modifications can be made in a suitable manner without departure from the scope of the invention as defined by the appended claims.

I claim:

1. A pump comprising:

a casing housing a working chamber and an impeller, said impeller being mounted in said casing on a rotational shaft;

said impeller comprising:

a blade wheel mounted on said rotational shaft for rotation therewith;

a plurality of pumping blades extending axially from the periphery of said blade wheel;

a cover mounted within said casing and fitted over said blade wheel for rotation therewith, said cover having an end face member defining one side of said working chamber and a cylindrical skirt portion depending from the periphery of said end face member and encircling said blade wheel, whereby a hollow interior space is defined between said end face member and said blade wheel, said end face member having a plurality of slots through which said blades extend into said working chamber; and a plurality of pockets formed in the interior surface of said cylindrical skirt portion of said cover, each of said pockets defining a mating surface for that portion of one of said blades extending into the interior of said impeller whereby said blade portion is flush against said mating surface during pumping; and actuator means for moving said blade wheel relative to said cover.

2. The pump of claim 1 wherein the contour of the inner surface of said skirt portion of said cover is substantially identical to the contour of said blade wheel and blades.

3. The pump of claim 1 wherein each of said pockets is defined by said mating surface, a peripheral surface in continuation with said mating surface and a joint surface in continuation with said peripheral surface.

4. The pump of claim 3 wherein said joint surface is substantially flat and lies in a plane extending radially from the axis of said rotational shaft.

5. The pump of claim 3 wherein said joint surface curves away from a plane extending radially from the axis of rotation and toward the mating surface of the pocket therebetween.

6. The pump of claim 1 wherein said end face member curves inwardly, into said working chamber.

* * * * *